US007325274B2

(12) United States Patent
Jeong

(10) Patent No.: US 7,325,274 B2
(45) Date of Patent: Feb. 5, 2008

(54) VACUUM CLEANER WITH DUST COLLECTING DEVICE

(75) Inventor: Hoi-Kil Jeong, Changwon-si (KR)

(73) Assignee: LG Electronics Inc., Seoul (KR)

( * ) Notice: Subject to any disclaimer, the term of this patent is extended or adjusted under 35 U.S.C. 154(b) by 560 days.

(21) Appl. No.: 10/878,032

(22) Filed: Jun. 29, 2004

(65) Prior Publication Data

US 2005/0005392 A1 Jan. 13, 2005

(30) Foreign Application Priority Data

Jul. 9, 2003 (KR) ..... 10-2003-0046280

(51) Int. Cl.
*A47L 9/16* (2006.01)

(52) U.S. Cl. ..... 15/352; 15/353; 55/429; 55/DIG. 3

(58) Field of Classification Search ..... 15/327.2, 15/352, 353; 55/429, DIG. 3
See application file for complete search history.

(56) References Cited

U.S. PATENT DOCUMENTS 4,278,456 A * 7/1981 Hug ..... 55/429
4,426,211 A * 1/1984 Ataka et al. ..... 15/352
4,745,654 A * 5/1988 Yamamoto et al. ..... 15/352
5,301,386 A * 4/1994 Thomas et al. ..... 15/353
5,657,509 A * 8/1997 Trautloff et al. ..... 15/353
5,664,285 A * 9/1997 Melito et al. ..... 15/352
5,935,279 A * 8/1999 Kilstrom ..... 55/429
6,168,641 B1 * 1/2001 Tuvin et al. ..... 55/DIG. 3
6,269,518 B1 * 8/2001 Yung ..... 15/352
6,640,385 B2 * 11/2003 Oh et al. ..... 15/352
6,757,933 B2 * 7/2004 Oh et al. ..... 15/353
6,775,882 B2 * 8/2004 Murphy et al. ..... 15/352
6,922,868 B1 * 8/2005 Jeong ..... 15/353
6,934,994 B2 * 8/2005 Oh et al. ..... 15/352

* cited by examiner

*Primary Examiner*—Theresa T. Snider
(74) *Attorney, Agent, or Firm*—Ked & Associates LLP

(57) ABSTRACT

A vacuum cleaner is disclosed. The vacuum cleaner includes a main body including a suction device therein and a depressed portion opened to its upper portion, a dust collecting device seated into the depressed portion of the main body and collecting dust in a cyclonic fashion, and a catching member provided in the dust collecting device, wherein catching steps are provided on at least both ends of the catching member and caught into an inner wall of the depressed portion. The depressed portion is formed with guide inclination surfaces and catching grooves at positions corresponding to the catching steps of the catching member, respectively. The dust collecting device comprises a dust tank in which foreign materials are collected, wherein the dust tank is provided with an inlet and an ejection port to communicate with the passage formed in the main body and a cover assembly mounted onto an upper end of the dust tank to open and close an inside of the dust tank, and the catching member is seated into the cover assembly. With such structure, it is possible to easily detach and mount the dust collecting device from and into the depressed portion of the main body, respectively, and the dust collecting device can be securely mounted.

19 Claims, 7 Drawing Sheets

VACUUM CLEANER WITH DUST COLLECTING DEVICE

BACKGROUND OF THE INVENTION

1. Field of Invention

The present invention relates to a vacuum cleaner, and more particularly, to a vacuum cleaner in which a dust collecting unit for collecting foreign materials sucked together with air is mounted to a main body from above.

2. Description of the Prior Art

A vacuum cleaner is an apparatus which sucks air containing foreign materials using a vacuum pressure generated by a suction force of a motor installed in a main body, collects the foreign materials in the dust collecting unit, and then casts away the collected foreign materials. Thus, since the foreign materials collected in the dust collecting unit should be cast away periodically, the dust collecting unit is detachably mounted to the main body.

FIG. 1 is a perspective view showing an appearance of a vacuum cleaner for filtering in a cyclonic fashion. According to this, a suction means providing a suction force for sucking air is provided in a main body 1 formed in a predetermined shape. A dust collecting unit 2 is detachably mounted to the main body 1. The dust collecting unit 2 collects foreign materials in the cyclonic fashion.

A hose 3 of flexible material is installed at a side of the main body 1, wherein the hose 3 is in communication with the suction means and the dust collecting unit 2 in the main body 1, and then functions to transmit the air containing the foreign materials to the dust collecting unit 2 by the suction force of the suction means.

The hose 3 is connected to an extension tube 4. A suction nozzle 5 is installed at a front end of the extension tube 4, and then sucks the foreign materials together with the air in an objective area for cleaning. A handle portion 6, which a user grips to operate the vacuum cleaner, is provided at a side of the extension tube 4, and a switch 7 for switching on or off the vacuum cleaner is provided adjacent to the handle portion 6.

Wheels 8 for causing the vacuum cleaner to travel are provided at a side of the main body 1. The wheels 8 having a predetermined diameter are provided at both ends of the main body 1, respectively. For the more smooth movement of the main body 1, a roller (not shown) is provided on an undersurface of the main body 1.

In the meantime, the main body 1 is provided with a discharge portion 9. The discharge portion discharges the air, which is sucked through the suction nozzle 5, and from which the foreign materials are filtered out, to an outside of the main body 1 while the air passes through the extension tube 4, the hose 3, and the dust collecting unit 2. Reference numeral 10 designates a power cord for supplying the vacuum cleaner with electric power for driving the vacuum cleaner.

However, the prior art vacuum cleaner has some problems as follows.

That is, in the prior art, the dust collecting unit 2 is provided at a rear side of the main body 1, and then is constituted so as to be detached or mounted in the direction in which the main body 1 moves by the wheels 8. Therefore, when the user intends to detach or mount the dust collecting unit 2, there is a problem in that the user should grip the main body 1 by one hand and handle the dust collecting unit 2 by the other hand.

In addition, since the conventional dust collecting unit 2 is inserted and mounted into the main body 1 without any separate fixing structure, there is a problem in that the dust collecting unit 2 can easily get removed by an impact applied from the outside.

Furthermore, the dust collecting unit 2 functions to connect the hose 3 and a side of the discharge portion 9 to be in communication with each other in the main body 1. If a mounting state of the dust collecting unit becomes disturbed by an external impact, the hose 3 and the discharge portion 9 are not in smooth communication with each other. Thus, the suction force of the suction means is not smoothly formed, so that there is a problem in that performance of the cleaner is deteriorated.

Moreover, if the dust collecting unit 2 is not in smooth communication with the hose 3 and the discharge portion 9, there is a problem in that the cleaner gets out of order since foreign materials are transmitted in the main body 1 through a portion where they are not properly connected with each other.

SUMMARY OF THE INVENTION

The present invention is conceived to solve the aforementioned problems in the prior art. Accordingly, an object of the present invention is to provide a vacuum cleaner where a dust collecting unit is more easily detached or mounted.

Another object of the present invention is to provide a vacuum cleaner wherein a dust collecting unit can be securely mounted.

A further object of the present invention is to provide a vacuum cleaner wherein exact connection between passages formed in a dust collecting unit and a main body, is maintained.

According to an aspect of the present invention for achieving the objects, there is provided a vacuum cleaner, comprising a suction part for sucking air containing foreign materials; a main body provided with a passage through which the air sucked through the suction part flows, the main body being formed with a depressed portion which is opened to at least its upper portion and is in communication with the passage; a suction means provided in the main body, the suction means providing a suction force for sucking the air; a dust collecting unit seated into the depressed portion, the dust collecting unit forming a portion of the passage and collecting the foreign materials; and a catching member provided in the dust collecting unit, catching steps being provided on at least both ends of the catching member, the catching steps being caught into an inner wall of the depressed portion with an elastic force; wherein the dust collecting unit moves from an upper portion to a lower portion of the main body, and then is mounted into the depressed portion.

Preferably, the depressed portion is formed with guide inclination surfaces and catching grooves in order at positions corresponding to the catching steps of the catching member, respectively.

The dust collecting unit may comprise a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly.

Further, the cover assembly may comprise a cover frame including a handle; a sealing member provided on a lower surface of the cover frame to be installed in close contact with the upper end of the dust tank; and a catching member including a grip portion seated into the handle, elastic deformable portions each of which has the catching step being provided at both ends of the catching member, the elastic deformable portions projecting through between the cover frame and the sealing member to a lower portion of the cover assembly to expose the catching steps.

Preferably, the catching member is supported by an elastic member in a direction in which the catching steps are projected outside of the cover assembly.

More preferably, each of the catching steps comprises an elastic sliding surface formed with a inclined surface in a direction away from an outer peripheral surface of the dust tank, and a mounting sliding surface connected to the elastic sliding surface and formed with a inclined surface in a direction opposite to the elastic sliding surface.

According to another aspect of the present invention, there is provided a vacuum cleaner, comprising a suction part including a suction port for sucking air containing foreign materials; a main body including a suction means therein, the suction means providing a suction force for sucking the air, the main body being provided with a passage through which an airflow formed by the suction means flows, the main body being formed with a depressed portion to be opened to at least its upper portion; a dust collecting unit including a dust tank, the inside of which is in communication with the passage, and a cover assembly detachably mounted to an upper end of the dust tank to shield the inside of the dust tank, the dust collecting unit being seated into the depressed portion from its upper portion and performing a dust collecting operation; and a catching member provided in the cover assembly, catching steps being provided on at least both ends of the catching member, respectively, the catching steps being caught into an inner wall of the depressed portion.

Preferably, the depressed portion is formed so that its mouth is opened to the upper portion of the main body, and the depressed portion is formed with guide inclination surfaces and catching grooves in order at positions corresponding to the catching steps of the catching member, respectively.

Further, the cover assembly may comprise a cover frame including a handle; a sealing member including a handle coupling portion connected to the handle, the handle coupling portion having an open slot through which a portion of the catching member is exposed, the sealing member being provided on a lower portion of the cover frame to be in close contact with the upper end of the dust tank; and an elastic member supporting the catching member with an elastic force so that the portion of the catching member is exposed through the open slot.

Furthermore, the catching member may comprise a grip portion seated into the handle of the cover frame and the handle coupling portion of the sealing member, a portion of the grip portion being exposed through the open slot; and elastic deformable portions formed to be extended at a right angle at both ends of the grip portion, respectively, the catching step is formed at a front end of each of the elastic deformable portions, the elastic deformable portions being deformable.

Preferably, each of the catching steps comprises an elastic sliding surface formed with a inclined surface in a direction away from the outer peripheral surface of the dust tank, and a mounting sliding surface connected to the elastic sliding surface and formed with a inclined surface in a direction opposite to the elastic sliding surface.

According to a further aspect of the present invention, there is provided a vacuum cleaner, comprising a suction part provided at a front end of an extension tube and sucking air containing foreign materials; a main body connected to the suction part through a suction hose and the extension tube, the main body being provided with a passage through which the air sucked through the suction part flows, the main body being formed with a depressed portion which is opened to at least its upper portion and is in communication with the passage; a suction means provided in the main body, the suction means providing a suction force for sucking the air; a dust collecting unit seated into the depressed portion from its upper portion to its lower portion, the dust collecting unit forming a portion of the passage and collecting the foreign materials; and a catching member provided in the dust collecting unit, catching steps being provided on at least both ends of the catching member, the catching steps being caught into catching grooves adjacent to guide inclination surfaces formed on an inner wall of the depressed portion with an elastic force, respectively.

Preferably, the dust collecting unit comprises a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly.

More preferably, the catching member is supported by an elastic member in a direction in which the catching steps are projected outside of the cover assembly, and wherein each of the catching steps comprises an elastic sliding surface formed with a inclined surface in a direction away from the outer peripheral surface of the dust tank, and a mounting sliding surface connected to the elastic sliding surface and formed with a inclined surface in a direction opposite to the elastic sliding surface.

According to a still further aspect of the present invention, there is provided a vacuum cleaner, comprising a suction part including a suction port for sucking air containing foreign materials; a main body, the suction part being pivotably hinge connected to a side of the main body, the main body including therein a passage through which an airflow sucked through the suction part flows, the main body being formed with a depressed portion to be opened to at least its upper portion; a suction means provided in the suction part or the main body, the suction means providing a suction force for sucking the air; a dust collecting unit seated into the depressed portion from its upper portion to its lower portion, the dust collecting unit forming a portion of the passage and collecting the foreign materials; and a catching member provided in the dust collecting unit, catching steps being provided on at least both ends of the catching member, the catching steps being caught into catching grooves adjacent to guide inclination surfaces formed on an inner wall of the depressed portion with an elastic force, respectively.

Further, the dust collecting unit may comprise a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly.

Preferably, the catching member is supported by an elastic member in a direction in which the catching steps are projected toward an outside of the cover assembly, and wherein each of the catching steps comprises an elastic sliding surface formed with a inclined surface in a direction away from the outer peripheral surface of the dust tank, and a mounting sliding surface connected to the elastic sliding surface and formed with a inclined surface in a direction opposite to the elastic sliding surface.

More preferably, the depressed portion is opened in an upper direction of the main body, and at the same time, is partially opened to a front surface of the main body.

Still more preferably, a handle is provided opposite to the suction part hinge connected to the main body.

According to the present invention as described above, there are advantages in that the dust collecting unit can be easily detached and mounted in the vacuum cleaner, and the dust collecting unit can be securely mounted.

According to a still further aspect of the present invention, there is provided a vacuum cleaner, comprising: a suction part including a suction port for sucking air containing foreign materials; a main body, the suction part being pivotably hinge connected to a side of the main body, the main body including therein a passage through which an airflow sucked through the suction part flows, the main body being formed with a depressed portion to be opened to at least its upper portion; a suction means provided in the suction part or the main body, the suction means providing a suction force for sucking the air; a dust collecting unit seated into the depressed portion, the dust collecting unit forming a portion of the passage and collecting the foreign materials, the dust collecting unit comprises, a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly; and a catching member provided in the dust collecting unit.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE PREFERRED EMBODIMENT

Hereinafter, preferred embodiments of a vacuum cleaner according to the present invention will be described in detail with reference to the accompanying drawings.

Figure 1:
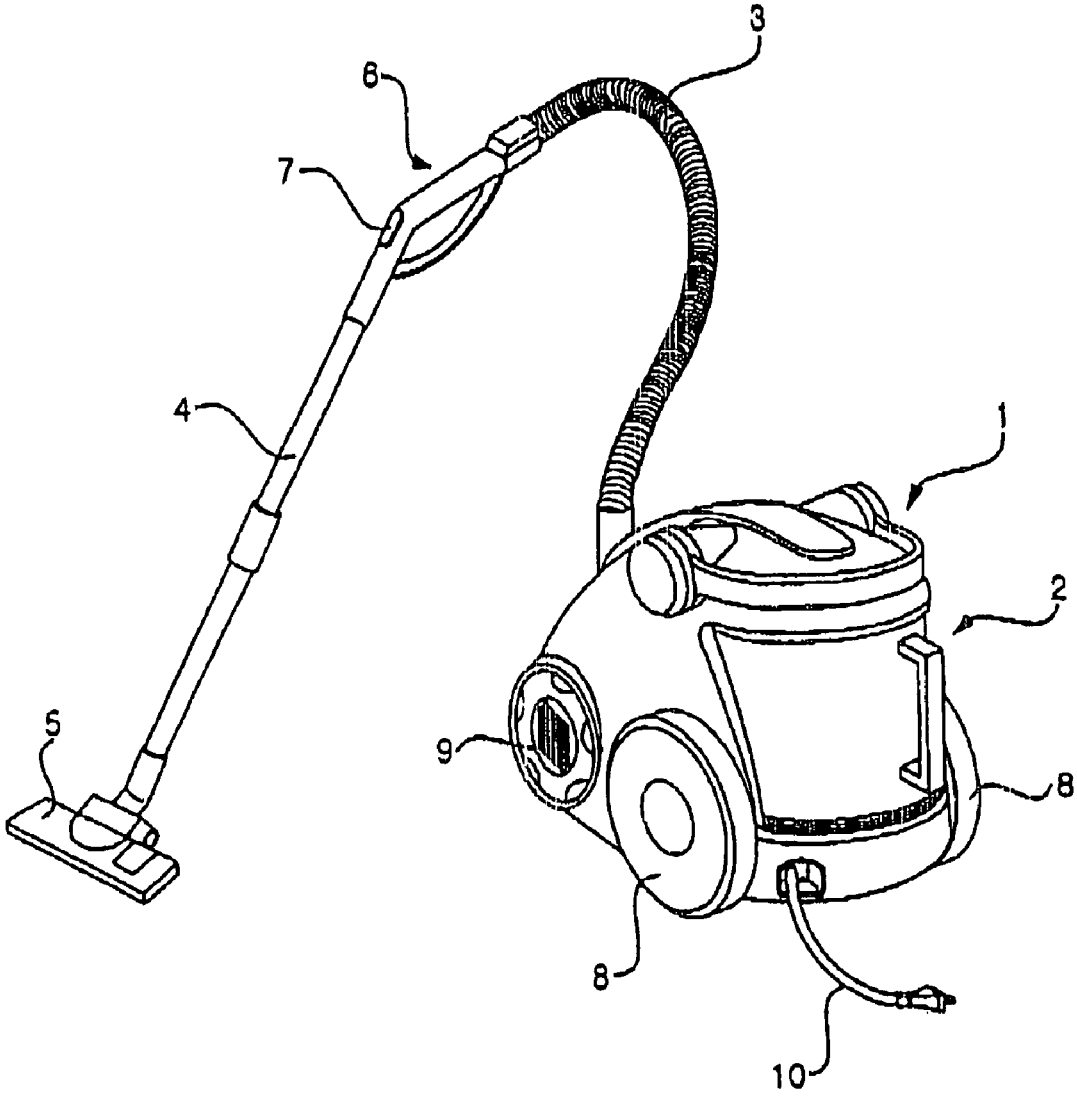
FIG. 1 Related Art
FIG. 1 is a perspective view showing the constitution of a general vacuum cleaner for performing a dust collecting in a cyclonic fashion.
Figure 2:
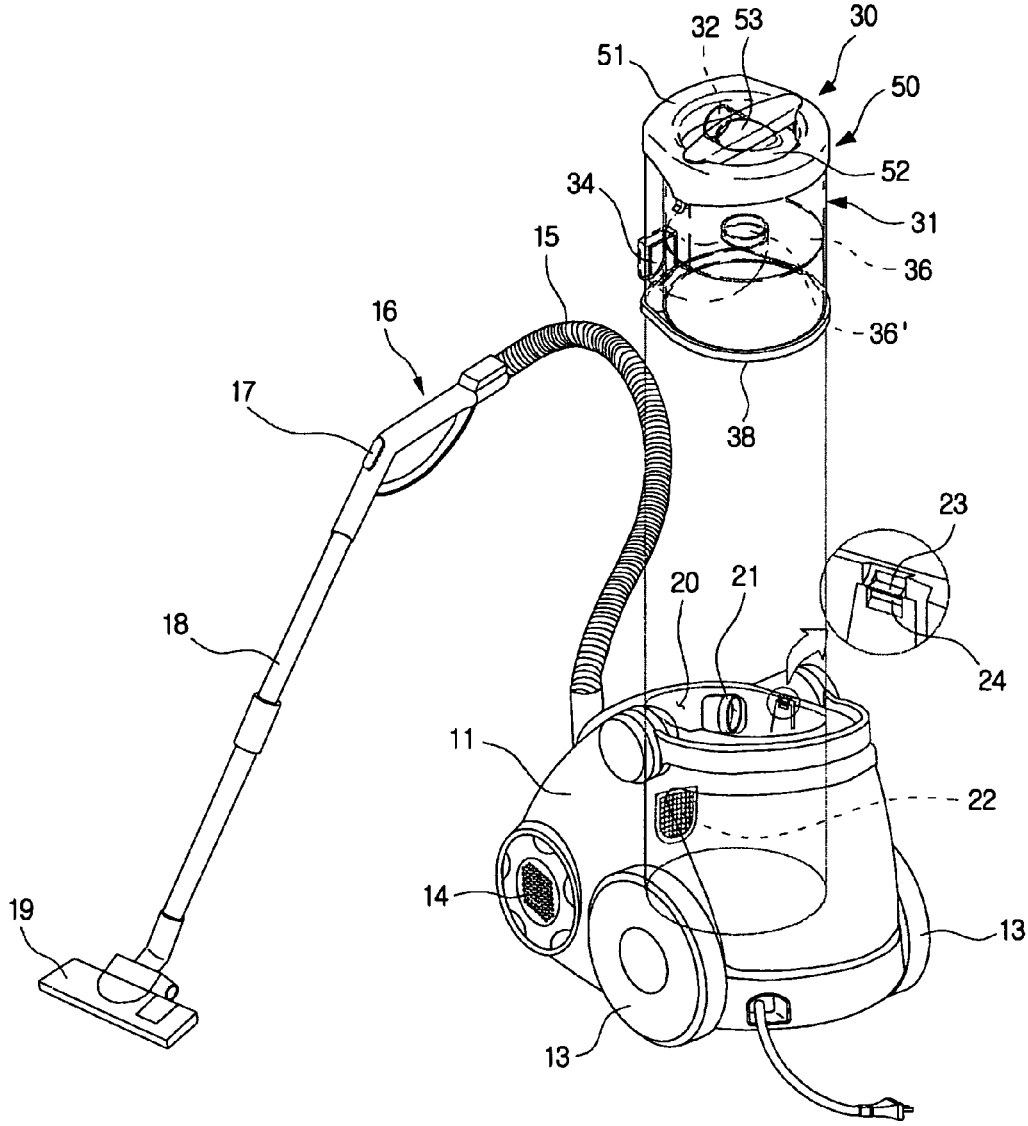
FIG. 2 is an exploded perspective view showing the constitution of a preferred embodiment of a vacuum cleaner according to the present invention.
Figure 3:
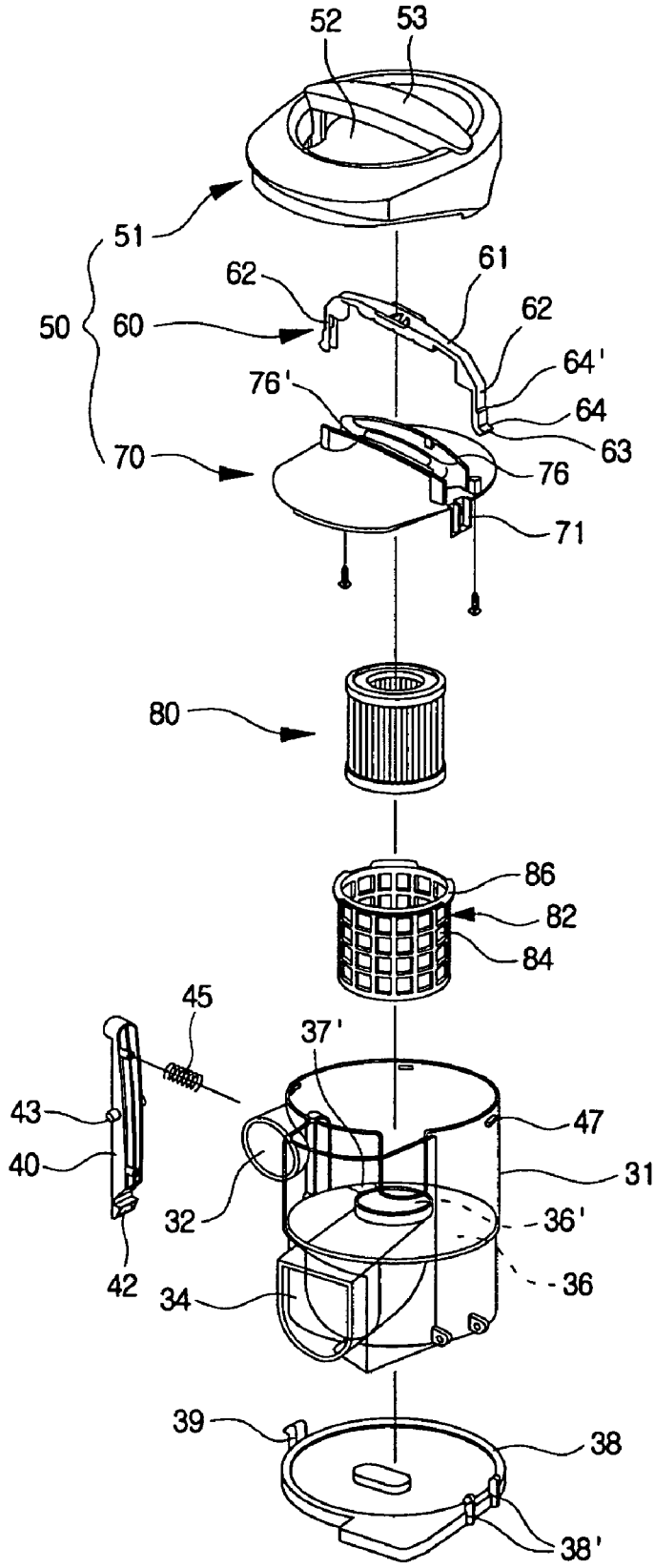
FIG. 3 is an exploded perspective view showing the constitution of a dust collecting unit constituting the embodiment of the present invention.
Figure 4A:
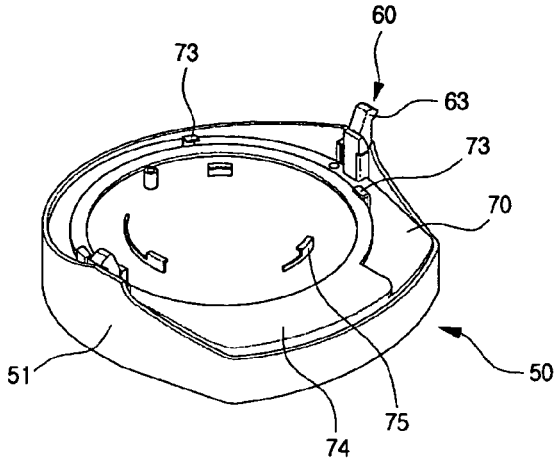
FIG. 4*a* is a perspective view showing the constitution of a cover assembly constituting the embodiment of the present invention.
Figure 4B:
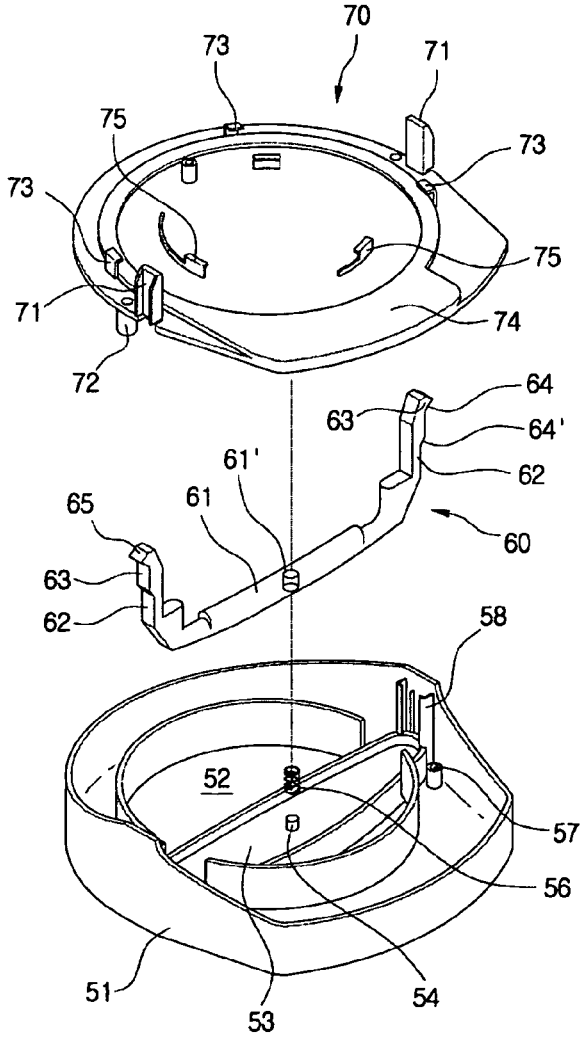
FIG. 4*b* is an exploded perspective view showing the constitution of the cover assembly constituting the embodiment of the present invention.
Figure 5:
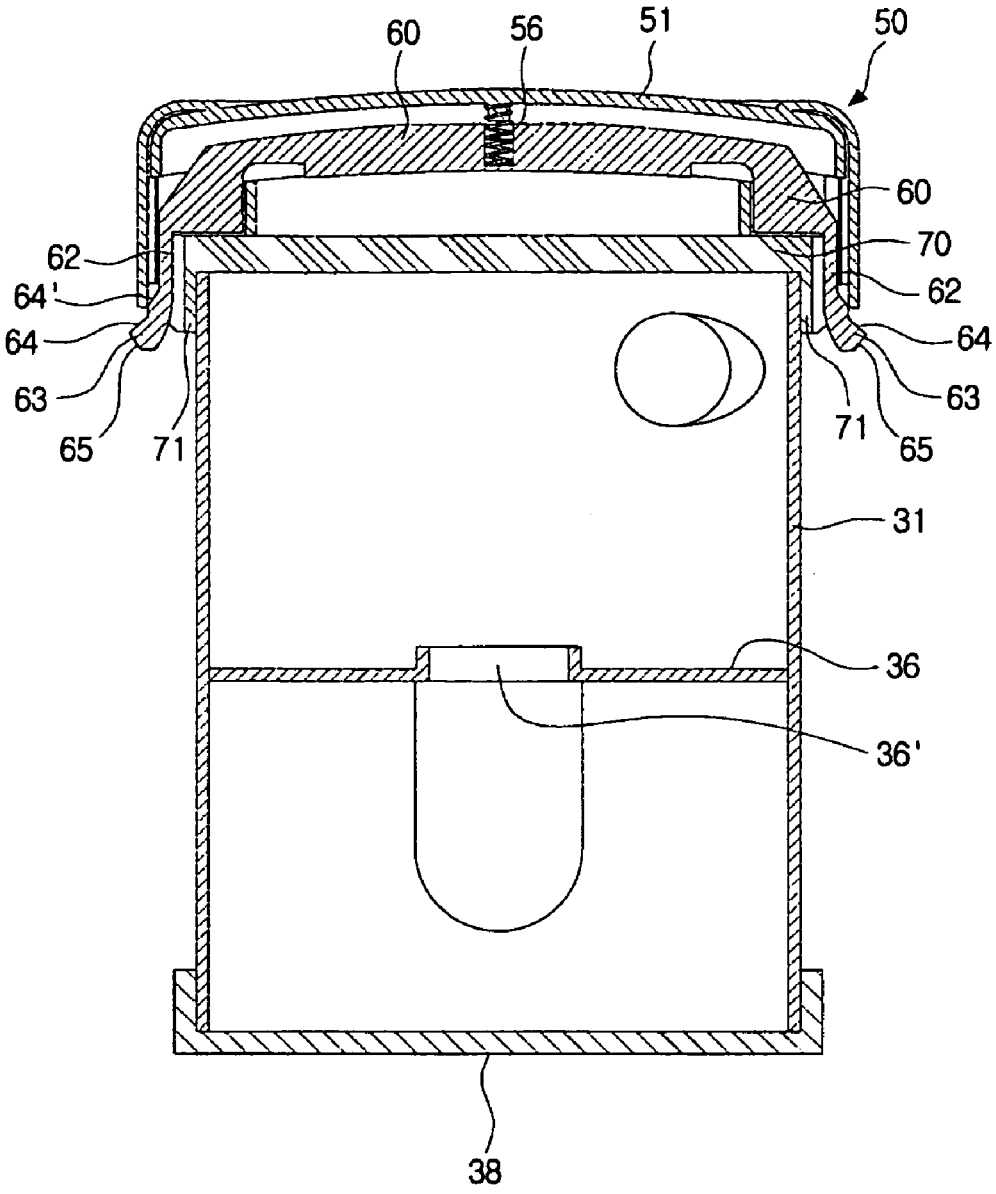
FIG. 5 is a sectional view showing the constitution of the dust collecting unit constituting the embodiment of the present invention.

FIG. 2 is an exploded perspective view of a canister vacuum cleaner according to the present invention; FIG. 3 is an exploded perspective view of the constitution of a dust collecting unit constituting the embodiment of the present invention; FIGS. 4*a* and 4*b* show a cover assembly of the dust collecting unit constituting the embodiment of the present invention; and FIG. 5 is a sectional view of the constitution of the dust collecting unit constituting the embodiment of the present invention.

Referring to these figures, a suction means (not shown), which provides a suction force for sucking foreign materials and air together, is provided in a main body 11 of the vacuum cleaner. Wheels 13 are provided at both outer ends of the main body 11. The wheels 13, which have a predetermined diameter, are for moving the main body 11. A roller (not shown) is further provided on the undersurface of the main body 11 in order for the main body to easily move. Reference numeral 14 designates a discharge portion for discharging the air from the main body 11 to its outside.

A suction hose 15 is provided at a front end of the main body 11. The suction hose 15 is formed of flexible material, and then may be freely bent to a certain extent. An end of the suction hose 15 is in communication with an inside of the main body 11, while the other end thereof is connected to an extension tube 18.

The extension tube 18 is connected to the suction hose 15, wherein a portion to which the suction hose 15 is connected is provided with a handle portion 16. The user gripping the handle portion by hand, the handle portion 16 enables a user to handle the extension tube 18. A suction nozzle 19 is provided at an end portion of the extension tube 18. The suction nozzle 19 functions to suck the foreign materials and the air by a vacuum suction force formed by the suction means in the main body 11. For reference, the suction means may not be provided in the main body 11 but the suction nozzle 19. Reference numeral 17 designates a switch for switching on or off the vacuum cleaner.

A depressed portion 20 is formed in the main body 11 so as to be opened to an upper portion of the main body 11. The depressed portion 20, which is formed where the main body 11 is internally depressed, is a portion where a dust collecting unit 30, which will be described below is seated. Therefore, the depressed portion 20 is formed in a shape corresponding to the dust collecting unit 30.

The depressed portion 20 is provided with a main body inlet 21 for communicating with the suction hose 15 and the dust collecting unit 30. In addition, a main body ejection port 22 is provided to be in communication with the discharge portion 14 through the suction means provided in the main body 11. The main body ejection port 22 communicates with the depressed portion 20. The main body ejection port 22 mutually communicates with an ejection port 34 of a dust tank 31, which will be described below.

In the meantime, guide inclination surfaces 23 and catching grooves 24 are formed at a mouth side edge of the depressed portion 20, respectively, wherein the guide inclination surfaces 23 are formed relatively above the catching grooves 24. Each of the guide inclination surfaces 23 is formed to be inclined downward approximately toward the center of the depressed portion 20. An upper portion of each of the catching grooves 24 is formed to be inclined in a direction opposite to the guide inclination surface 23. Catching steps 63 of a catching member 60, which will be described below, are guided by and caught into the guide inclination surfaces 23 and the catching grooves 24.

The dust collecting unit 30 is provided with the dust tank 31. The dust tank 31 is formed in a generally circular cylindrical shape, wherein an upper end side of the dust tank 31 is formed with an inlet 32 communicating with a side of the suction hose 15 through the main body inlet 21. The inlet 32 is formed to pass through the dust tank 31 in the approximately tangential direction with respect to an outer surface of the dust tank 31. Therefore, the air sucked into the dust tank 31 through the inlet 32 flows in a circle along an inner edge of the dust tank 31.

Passing through a lower end side of the dust tank 31, the ejection port 34 is formed. The ejection port 34, which is formed at the lower side of the dust tank 31, communicates with a side of the suction means through the main body ejection port 22. When the main body ejection port 22 and the ejection port 34 are connected, packing members may be provided therebetween in order to prevent a leakage of the suction force. The packing members maintain airtightness between the main body ejection port 22 and the ejection port 34, and at the same time, can function to filter out large foreign materials that may be introduced to a suction means side through the main body ejection port 22. To this end, meshes having predetermined size are provided in the packing members.

A compartment 36 is provided in the dust tank 31 so as to divide the dust tank 31 into a portion including the inlet 32 and a portion including the ejection port 34. An air vent 36' is formed at the center of the compartment 36, and is in direct communication with the ejection port 34. A foreign material vent 37' is formed at an edge of the compartment 36, and then functions to transmit the foreign materials to a lower portion of the dust tank 31.

The lower end of the dust tank 31 is provided with a base plate 38. The base plate 38 is installed at the dust tank 31 to be opened or closed about a hinge portion 38'. The base plate 38 rotates about the hinge portion 38' and then opens the lower portion of the dust tank 31, causing the foreign materials transmitted through the foreign material vent 37' to be discharged to the outside. A catching projection 39 is formed in order to maintain the lower portion of the dust tank 31 closed by mounting the base plate 38 to the lower end of the dust tank 31. The catching projection 39 is positioned opposite to the hinge portion 38'.

In addition, a locking lever 40 is provided at an outer surface side of the dust tank 31. A catching protrusion 42, which is hooked with the catching projection 39, is formed at a lower end of the locking lever 40. Hinge pins 43 are provided on both sides of the intermediate position of the locking lever 40, so that the locking lever 40 is installed on the outer surface of the dust tank 31 in order for both ends of the locking lever 40 to pivot upon the hinge pins 43. A spring 45 is installed opposite to the catching protrusion 42 of the locking lever 40. An end of the spring 45 is supported on the inner surface of the locking lever 40, while the other end thereof is supported on the outer surface of the dust tank 31, causing the state that the catching protrusion 42 of the locking lever 40 is hooked to the catching projection 39 of the base plate 38 to be maintained.

A plurality of locking projections 47 are formed around an upper end of the outer peripheral surface of the dust tank 31. The locking projections 47 are portions for joining a cover assembly 50, which will be described below, to the dust tank 31.

The cover assembly 50 is mounted on an upper end of the dust tank 31, and then, functions to shield the upper end of the dust tank 31 and cause the dust collecting unit 30 itself to be seated and fixed to the depressed portion 20 of the main body 11.

The cover assembly 50 is provided with a cover frame 51. The cover frame 51 is provided with a circular through portion 52 which has a predetermined diameter and passes through the center of the cover frame 51 upward and downward. A handle 53 is formed across the through portion 52. The handle 53 enables the user to grip and handle the dust collecting unit 30 by hand. A catching boss 54 is formed on the center of the undersurface of the handle 53. An end of an elastic member 56, which supports the catching member 60 which will be described below, is supported on the catching boss 54.

A predetermined space is formed in the cover frame 51 to be opened to its lower portion. That is, the space is formed between an outer peripheral surface of the cover frame 51 and an inner peripheral surface of the through portion 52, and is opened toward a lower portion of the cover frame 51. Guide ribs 58 are formed at both ends of the space, respectively. The guide ribs 58 function to guide lifting the catching member 60.

The catching member 60 is provided with a grip portion 61 having a predetermined length to be seated into the handle 53. The grip portion 61, which is naturally pressed by a user's finger tip when the user grips the handle 53, is formed with a groove 61' at a position corresponding to the catching boss 54. The other end of the elastic member 56 is seated into the groove 61'. Therefore, the grip portion 61 is always subjected to an elastic force toward a lower end of the cover frame 51 by the elastic member 56.

Elastic deformable portions 62, each of which is directed downward at an approximately right angle and extended at the predetermined length, are formed at both ends of the grip portion 61. The catching steps 63 are provided at front ends of the elastic deformable portions 62 so as to be projected outward, respectively.

The catching steps 63 are formed to be projected outside of the elastic deformable portions 62, respectively, wherein an elastic sliding surface 64 is formed with a predetermined inclination relatively above each of the catching steps 63. Each of the elastic sliding surfaces 64 is formed to be inclined downward in a direction projecting outward from its upper portion to its lower portion. Mounting sliding surfaces 65 are formed correspondingly to the elastic sliding surfaces 64, respectively. The mounting sliding surfaces 65 are formed to be inclined opposite to the elastic sliding surfaces 64, respectively.

Here, the elastic sliding surfaces 64 cause the elastic deformable portions 62 to be deformed by cooperating with upper ends of the catching grooves 24 and the cover frame when the dust collecting unit 30 is detached from the depressed portion 20, while the mounting sliding surfaces 65 cause the elastic deformable portions 62 to be deformed by cooperating with the guide inclination surfaces 23 when the dust collecting unit 30 is mounted to the depressed portion 20.

In the meantime, separately from the elastic sliding surfaces 64, the elastic deformable portions 62 may be elastically deformed by forming a second elastic sliding surfaces 64' on the elastic deformable portions 62, respectively. That is, a structure, which may be elastically deformed by selectively cooperating with the second elastic sliding surfaces 64', may be formed at corresponding positions of the cover frame 51.

A sealing member 70 performs sealing between the cover assembly 50 and the dust tank 31. Guide covers 71 are formed at both ends of a lower surface of the sealing member 70 at positions corresponding to the guide ribs 58 of the cover frame 51, respectively. The guide ribs 58 and the guide covers 71 cooperate with each other, and then, function to guide lifting the elastic deformable portions 62 of the catching member 60. Reference numeral 72 designates a second fixing boss where a fastening hole for fastening the sealing member 70 and the cover frame 51 to each other is formed.

A plurality of fixing projections 73, which are hooked to the locking projections 47 of the dust tank 31, respectively, are formed at the lower surface of the sealing member 70. The fixing projections 73 are formed at positions corresponding to the locking projections 47 such that they are equal in number to each other. A sealing material 74 is attached onto the lower surface of the sealing member 70 at a position corresponding to an edge of the upper end of the dust tank 31. The sealing material 74 prevents leakage between the sealing member 70 and the dust tank 31. Therefore, the sealing material 74 is positioned more inside than the fixing projections 73, and has a relatively large area portion according to a shape of the dust tank 31.

Filter fixing projections 75 are formed at a position corresponding to the inner portion of the dust tank 31 in the intermediate portion of the lower surface of the sealing member 70. As the fixing projections 73, a plurality of the filter fixing projections 75 are formed to be spaced apart by a predetermined interval from each other.

A handle coupling portion 76 is formed on an upper surface of the sealing member 70 at a position corresponding to the handle 53 of the cover frame 51. The handle coupling portion 76 functions to shield a lower portion of the handle 53 of the cover frame 51. An open slot 76' through which a portion of the grip portion 61 is exposed is elongately formed in the handle coupling portion 76. The portion of the grip portion 61 is exposed to the outside through the open slot 76' by an elastic force of the elastic member 56.

A filter 80 is mounted on the lower surface of the sealing member 70. The filter 80 filters out the foreign materials that are contained in the sucked air. The filter 80 is seated in a filter frame 82. The filter frame 82 is in the form of a circular cylinder with a side thereof opened, and a plurality of ventilating portions 84 are provided around an outer peripheral surface of the filter frame 82 in order for its inside and its outside to communicate with each other. Mounting flanges 86 are formed on an upper end of the filter frame 82 at positions corresponding to the filter fixing projections 75 of the sealing member 70. Therefore, the filter 80 is seated in the filter frame 82, and the filter frame 82 in which the filter 80 is housed is mounted on the sealing member 70.

Figure 8:
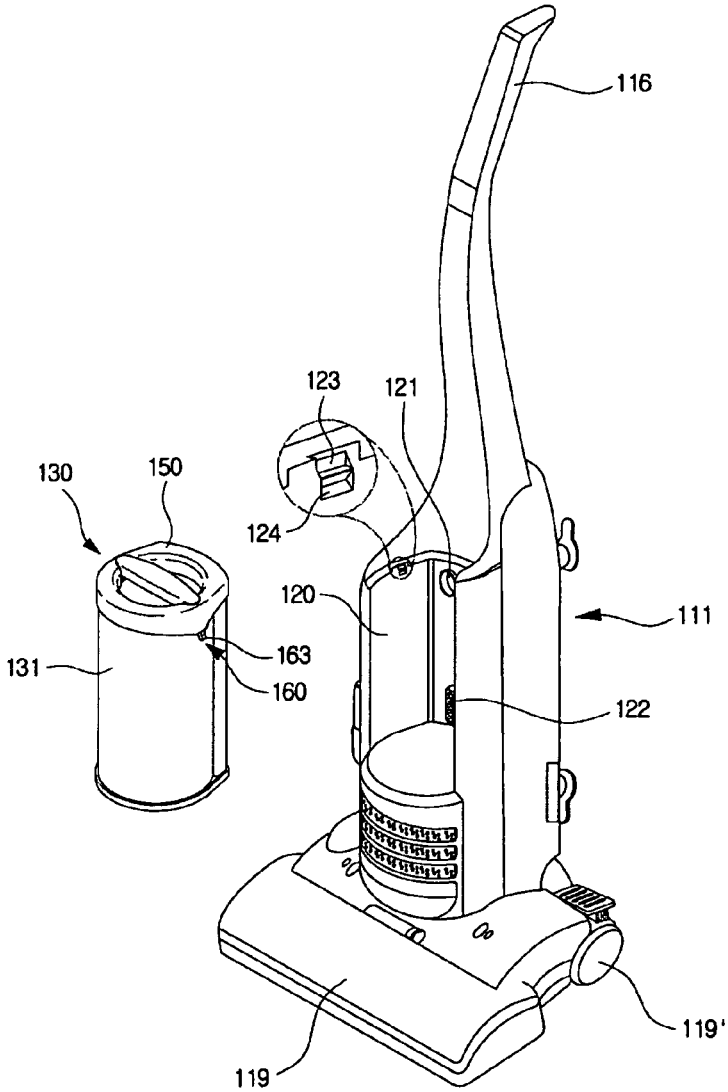
FIG. 8 is an exploded perspective view showing the constitution of another embodiment of the present invention.

Next, FIG. 8 shows an embodiment wherein the present invention is applied to an upright cleaner. As shown in the figure, a handle 116 is formed at an upper end of a main body 111. A suction head 119 is hinge connected to a lower end of the main body 111 in order to pivot thereabout at a predetermined angle.

A suction port for sucking air and foreign materials is provided at an undersurface of the suction head 119. The suction head 119 is provided with wheels 119', causing the cleaner to smoothly move. The main body 111 and the suction port of the suction head 119 communicate with each other through a suction hose (not shown). For reference, a motor (not shown) as a suction means for generating a suction force for sucking the air may be provided in the main body 111 or the suction head 119.

The main body 111 is provided with a depressed portion 120. At least an upper portion of the depressed portion 120 is opened toward an upper portion of the main body 111. The figure of the present embodiment shows that the depressed portion 120 is also partially opened to a front surface of the main body 111.

A main body inlet 121 is provided in the depressed portion 120, so that a side of the suction head 119 communicates with a dust collecting unit 130 provided in the depressed portion 120. The depressed portion 120 is also provided with a main body ejection port 122 for communicating with the dust collecting unit 130 and the suction means.

A guide inclination surface 123 and a catching groove 124 are provided at each of both opposite positions on a mouth edge of an upper end of the depressed portion 120. The guide inclination surfaces 123 are formed above the catching grooves 24, respectively. The guide inclination surfaces 123 and the catching grooves 24 are for mounting the dust collecting unit 130, which will be described below.

In the meantime, the dust collecting unit 130 is provided to be mounted into and detached from the depressed portion 120 through the upper portion of the depressed portion 120. The dust collecting unit 130 collects the foreign materials contained in the air introduced through the main body inlet 121, and then transmits the air to the main body ejection port 122. The constitution of the dust collecting unit 130 is similar to that of the previous embodiment.

That is, a cover assembly 150 is provided on an upper portion of the dust tank 131. Catching member 160 is provided on both ends of the cover assembly 150 so that catching steps 163 are projected at positions corresponding to the guide inclination surfaces 123 and catching grooves 124, respectively. Since the constitution of the dust collecting unit 130 is similar to that of the previous embodiment, the details will be omitted.

An operation of the vacuum cleaner according to the present invention as constituted above will be described below.

Figure 7A:
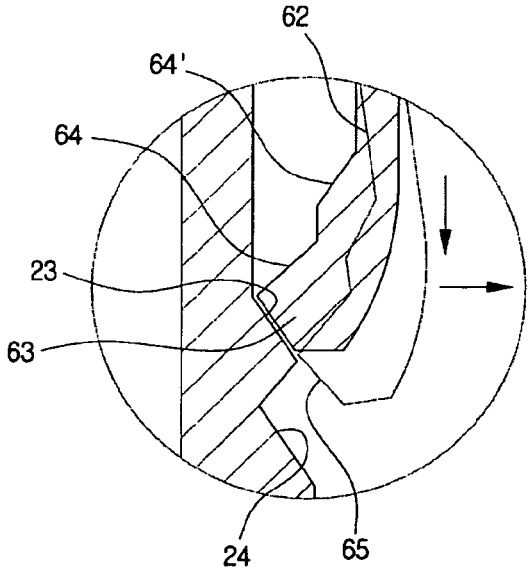
FIG. 7*a* is an operational view explaining the process for mounting the dust collecting unit into a depressed portion in the embodiment of the present invention.
Figure 7B:
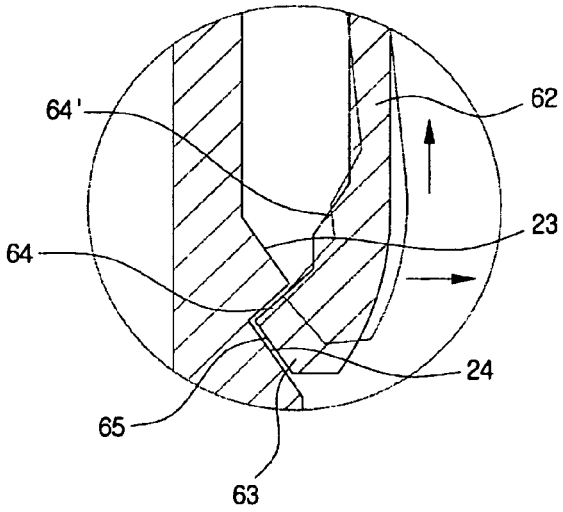
FIG. 7*b* is an operational view explaining the process for detaching the dust collecting unit from the depressed portion in the embodiment of the present invention.

In the present invention, when the dust collecting unit 30 is mounted into the depressed portion 20, the catching steps 63 of the catching member 60 is caught on the catching grooves 24, which is shown in FIG. 7*b*.

Supported by the elastic member 56, the catching member 60 is seated in a space formed by the handle 53 of the cover frame 51 and the handle coupling portion 76 of the sealing member 70. At this time, the grip portion 61 of the catching member 60 is exposed through the open slot 76' of the handle coupling portion 76.

In addition, the elastic deformable portions 62 are positioned in a space formed by the guide ribs 58 and the guide covers 71. Of course, the catching steps 63 formed at the front ends of the elastic deformable portions 62 are projected toward lower portions of both ends of the cover assembly 50, respectively. The catching steps 63 are projected so that the grip portion 61 of the catching member 60 is exposed through the open slot 76' by the elastic member 56.

In such a state, if the dust collecting unit 30 is mounted into the depressed portion 20, the mounting sliding surfaces 65 of the catching steps 63 are guided along the guide inclination surfaces 23 of the depressed portion 20. Therefore, at a lowermost ends of the guide inclination surfaces 23, as shown with a dotted line in FIG. 7*a*, as the catching steps 63 are pushed inward, an elastic deformation of the elastic deformable portions 62 is generated.

In addition, if the catching steps 63 are seated onto the catching grooves 24 past the guide inclination surfaces 23, respectively, the elastic deformable portions 62 return to their original state as shown with a solid line in FIG. 7*b*. In the state that the dust collecting unit 30 is mounted into the depressed portion 20, the catching member 60 is in the state shown in FIG. 5.

Thus, in the state that the dust collecting unit 30 is mounted into the depressed portion 20, the catching steps 63 are seated and caught into the catching grooves 24, respectively. Therefore, the dust collecting unit 30 is securely mounted into the depressed portion 20.

In the meantime, in order to detach the dust collecting unit 30 from the depressed portion 20, the user grips the handle 53, and then pushes the grip portion 61 of the catching member 60. If the grip portion 61 is pushed, overcoming the elastic force of the elastic member 56, the catching member 60 moves. Therefore, the elastic deformable portions 62 move along between the guide ribs 58 and the guide covers 71, respectively.

Figure 6:
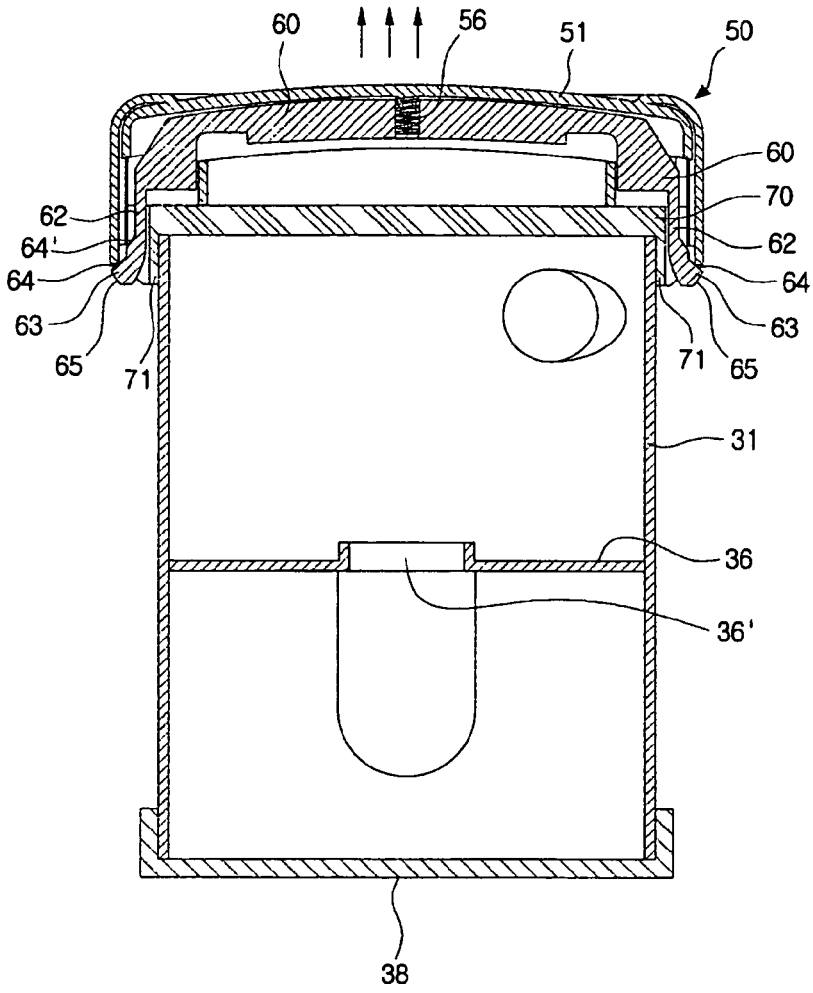
FIG. 6 is a view showing an operation of the embodiment of the present invention.

At this time, if the catching member 60 moves relatively upward as shown in FIG. 6, the elastic sliding surfaces 64 of the catching steps 63 come into contact with the cover frame 51, so that the elastic deformable portions 62 are deformed. That is, by the elastic deformation of the elastic deformable portions 62, the catching steps 63 move relatively in the direction to come into close contact with the outer peripheral surface of the dust tank 31.

Therefore, as shown with a dotted line in FIG. 7*b*, the catching steps 63 cannot emerge from the catching grooves 24. That is, the catching steps 63 are no more caught into the catching grooves 24. In such a state, only if the user lifts the dust collecting unit 30 to an upper portion of the depressed portion 20, the dust collecting unit 30 can emerge from the depressed portion 20.

At this time, pulled upward from the depressed portion 20 which is opened to the upper portion of the main body 11, the dust collecting unit 30 is detached. Therefore, the user may detach the dust collecting unit 30 with the main body 11 not gripped separately by hand. It is the reason why the dust collecting unit 30 is detached while pulled in the direction opposite to the action of self weight of the main body 11.

In addition, the catching member 60 intends to always maintain the state that the grip portion 61 is exposed to an outside of the open slot 76' by the elastic force of the elastic member 56. Therefore, the catching steps 63 are projected outside of the cover frame 51 and are relatively spaced apart from the outer peripheral surface of the dust tank 31.

For reference, since an operation of the embodiment shown in FIG. 8 is the same as described above, its additional explanation will be omitted.

According to the present invention as constructed above, the following advantages can be expected.

First, in the present invention, since the depressed portion is formed in the main body so that the dust collecting unit is mounted into the depressed portion through the open upper portion of the main body, it is easy to detach the dust collecting unit from the main body. That is, a user can detach the dust collecting unit by pulling it by one hand with the main body not gripped.

In addition, in the present invention, since the catching steps of the catching member provided in the dust collecting unit are caught into the catching grooves formed in the depressed portion of the main body when the dust collecting unit is mounted into the main body, the fastening state of the dust collecting unit can be made more secure.

Therefore, in the present invention, even if external impacts and the like are generated when the vacuum cleaner is used, since the dust collecting unit does not shift in its position, the leakage from a passage connected to the dust collecting unit is not generated, causing operational reliability of the vacuum cleaner to be more improved.

The scope of the present invention is not limited to the embodiments described above but is defined by the appended claims. It will be apparent that those skilled in the art can make various modifications and changes thereto within the scope of the invention defined by the claims.

For example, although only the embodiments which are applied to the canister and upright cleaners are disclosed herein, the present invention may be applied to various kinds of vacuum cleaners. Also, various dust collecting fashions, such as a cyclonic fashion, a paper filtering fashion, and the like may be applied to the dust collecting units.

What is claimed is:

1. A vacuum cleaner, comprising:

a suction part configured to suck in air containing foreign materials;

a main body provided with a passage through which the air sucked through the suction part flows, the main body being formed with a depressed portion at least an upper portion of which is open and which is in communication with the passage;

a suction force device provided in the main body, the suction force device providing a suction force for sucking the air;

a dust collecting device seated into the depressed portion, the dust collecting device forming a portion of the passage and collecting the foreign materials; and a catching member provided in the dust collecting device, catching steps being provided on at least both ends of the catching member, the catching steps being caught into an inner wall of the depressed portion with an elastic force, wherein the dust collecting device moves from the upper portion to a lower portion of the main body, and then is mounted into the depressed portion and wherein the dust collection device comprises:

a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly.

2. The vacuum cleaner as claimed in claim 1, wherein the depressed portion is formed with guide inclination surfaces and catching grooves at positions corresponding to the catching steps of the catching member, respectively.

3. The vacuum cleaner as claimed in claim 1, wherein the cover assembly comprises:

a cover frame including a handle;

a sealing member provided on a lower surface of the cover frame to be installed in close contact with the upper end of the dust tank; and the catching member including a grip portion seated into the handle, elastic deformable portions each of which has the catching step provided at both ends of the catching member, the elastic deformable portions projecting through between the cover frame and the sealing member to a lower portion of the cover assembly to expose the catching steps.

4. The vacuum cleaner as claimed in claim 3, wherein the catching member is supported by an elastic member in a direction in which the catching steps are projected outside of the cover assembly.

5. The vacuum cleaner as claimed in claim 3, wherein each of the catching steps comprises an elastic sliding surface formed with an inclined surface in a direction away from an outer peripheral surface of the dust tank, and a mounting sliding surface connected to the elastic sliding surface and formed with an inclined surface in a direction opposite to the elastic sliding surface.

6. A vacuum cleaner, comprising:

a suction part including a suction port configured to suck in air containing foreign materials; a main body including a suction device therein, the suction device providing a suction force for sucking the air, the main body being provided with a passage through which an airflow formed by the suction device flows, the main body being formed with a depressed portion at least an upper portion of which is open;

a dust collecting device including a dust tank, an inside of which is in communication with the passage, and a cover assembly detachably mounted to an upper end of the dust tank to shield the inside of the dust tank, the dust collecting device being seated into the depressed portion from the upper portion and performing a dust collecting operation; and a catching member provided in the cover assembly, catching steps being provided on at least both ends of the catching member, respectively, the catching steps being caught into an inner wall of the depressed portion.

7. The vacuum cleaner as claimed in claim 6, wherein the depressed portion having a mouth opened toward the upper portion of the main body, and guide inclination surfaces and catching grooves at positions corresponding to the catching steps of the catching member, respectively.

8. The vacuum cleaner as claimed in claim 6, wherein the cover assembly comprises:

a cover frame including a handle;

a sealing member including a handle coupling portion connected to the handle, the handle coupling portion having an open slot through which a portion of the catching member is exposed, the sealing member being provided on a lower portion of the cover frame to be in close contact with the upper end of the dust tank; and an elastic member supporting the catching member with an elastic force so that the portion of the catching member is exposed through the open slot.

9. The vacuum cleaner as claimed in claim 8, wherein the catching member comprises:

a grip portion seated into the handle of the cover frame and the handle coupling portion of the sealing member, a portion of the grip portion being exposed through the open slot; and elastic deformable portions formed to be extended at a right angle at both ends of the grip portion, respectively, wherein the catching step is formed at a front end of each of the elastic deformable portions.

10. The vacuum cleaner as claimed in claim 9, wherein each of the catching steps comprises an elastic sliding surface formed with an inclined surface in a direction away from an outer peripheral surface of the dust tank, and a mounting sliding surface connected to the elastic sliding surface and formed with an inclined surface in a direction opposite to the elastic sliding surface.

11. A vacuum cleaner, comprising:

a suction part provided at a front end of an extension tube and configured to suck air containing foreign materials;

a main body connected to the suction part through a suction hose and the extension tube, the main body being provided with a passage through which the air sucked through the suction part flows, the main body being formed with a depressed portion at least an upper portion of which is open and which is in communication with the passage;

a suction device provided in the main body, the suction device providing a suction force for sucking the air;

a dust collecting device seated into the depressed portion from the upper portion to a lower portion, the dust collecting device forming a portion of the passage and collecting the foreign materials; and a catching member provided in the dust collecting device, catching steps being provided on at least both ends of the catching member, the catching steps being caught into catching grooves adjacent to guide inclination surfaces formed on an inner wall of the depressed portion with an elastic force, respectively.

12. A vacuum cleaner, comprising:

a suction part provided at a front end of an extension tube and configured to suck air containing foreign materials;

a main body connected to the suction part through a suction hose and the extension tube, the main body being provided with a passage through which the air sucked through the suction part flows, the main body being formed with a depressed portion at least an upper portion of which is open and which is in communication with the passage;

a suction device provided in the main body, the suction device providing a suction force for sucking the air;

a dust collecting device seated into the depressed portion from the upper portion to a lower portion, the dust collecting device forming a portion of the passage and collecting the foreign materials; and a catching member provided in the dust collecting device, catching steps being provided on at least both ends of the catching member, the catching steps being caught into catching grooves adjacent to guide inclination surfaces formed on an inner wall of the depressed portion with an elastic force, respectively, wherein the dust collecting device, comprises:

a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly.

13. The vacuum cleaner as claimed in claim 12, wherein the catching member is supported by an elastic member in a direction in which the catching steps project outside of the cover assembly, and wherein each of the catching steps comprises an elastic sliding surface formed with an inclined surface in a direction away from an outer peripheral surface of the dust tank, and a mounting sliding surface connected to the elastic sliding surface and formed with an inclined surface in a direction opposite to the elastic sliding surface.

14. A vacuum cleaner, comprising:

a suction part including a suction port configured to suck in air containing foreign materials;

a main body, the suction part being pivotably hinge connected to a side of the main body, the main body including therein a passage through which an airflow sucked through the suction part flows, the main body being formed with a depressed portion at least an upper portion of which is open;

a suction device provided in the suction part or the main body, the suction device providing a suction force that sucks the air;

a dust collecting device seated into the depressed portion from the upper portion to a lower portion, the dust collecting device forming a portion of the passage and collecting the foreign materials; and a catching member provided in the dust collecting device, catching steps being provided on at least both ends of the catching member, the catching steps being caught into catching grooves adjacent to guide inclination surfaces formed on an inner wall of the depressed portion with an elastic force, respectively.

15. A vacuum cleaner, comprising:

a suction part including a suction port configured to suck in air containing foreign materials;

a main body, the suction part being pivotably hinge connected to a side of the main body, the main body including therein a passage through which an airflow sucked through the suction part flows, the main body being formed with a depressed portion at least an upper portion of which is open;

a suction device provided in the suction part or the main body, the suction device providing a suction force that sucks the air;

a dust collecting device seated into the depressed portion from the upper portion to a lower portion, the dust collecting device forming a portion of the passage and collecting the foreign materials; and a catching member provided in the dust collecting device, catching steps being provided on at least both ends of the catching member, the catching steps being caught into catching grooves adjacent to guide inclination surfaces formed on an inner wall of the depressed portion with an elastic force, respectively, wherein the dust collecting device, comprises:

a dust tank in which the foreign materials are collected, the dust tank being provided with an inlet and an ejection port to communicate with the passage formed in the main body; and a cover assembly mounted onto an upper end of the dust tank to open and close an inside of the dust tank, the catching member being seated into the cover assembly.

16. The vacuum cleaner as claimed in claim 15, wherein the catching member is supported by an elastic member in a direction in which the catching steps project toward an outside of the cover assembly, and wherein each of the catching steps comprises an elastic sliding surface formed with an inclined surface in a direction away from an outer peripheral surface of the dust tank, and a mounting sliding surface connected to the elastic sliding surface and formed with an inclined surface in a direction opposite to the elastic sliding surface.

17. The vacuum cleaner as claimed in claim 15, wherein the depressed portion is open toward an upper direction of the main body, and at the same time, is partially open toward a front surface of the main body.

18. The vacuum cleaner as claimed in claim 15, wherein a handle is provided opposite to the suction part.

19. A vacuum cleaner, comprising:

a suction part including a suction port that sucks in air containing foreign materials;

a main body, the suction part being pivotably hinge connected to a side of the main body, the main body including therein a passage through which an airflow sucked through the suction part flows, the main body being formed with a depressed portion at least an upper portion of which is open;

a suction device provided in the suction part or the main body, the suction device providing a suction force for sucking the air;

a dust collecting device seated into the depressed portion, the dust collecting device forming a portion of the passage and collecting the foreign materials, wherein the dust collecting device comprises:

a dust tank in which the foreign materials are collected, the dust tank being provided with an inlet and an ejection port to communicate with the passage formed in the main body; and a cover assembly mounted onto an upper end of the dust tank to open and close an inside of the dust tank; and a catching member provided in the dust collecting device, the catching member being seated into the cover assembly and being released by a user pressing down on the cover assembly.

* * * * *